US005441235A

United States Patent [19]

Narasimhan et al.

[11] Patent Number: 5,441,235

[45] Date of Patent: Aug. 15, 1995

[54] TITANIUM NITRIDE COATED VALVE AND METHOD FOR MAKING

[75] Inventors: Sundaram L. Narasimhan, Marshall; Stephen B. Caird, Saginaw, both of Mich.; Flavio A. Rigamonti, Turin, Italy

[73] Assignee: Eaton Corporation, Cleveland, Ohio

[21] Appl. No.: 246,651

[22] Filed: May 20, 1994

[51] Int. Cl.[6] ..... F01L 3/00

[52] U.S. Cl. ..... 251/368; 123/188.3

[58] Field of Search ..... 251/368; 123/188.3; 29/890.128

[56] References Cited

U.S. PATENT DOCUMENTS 4,675,964 6/1987 Allison ..... 29/156.7 R
4,852,531 8/1989 Abkowitz et al. ..... 123/188 AA
4,904,528 2/1990 Gupta et al. ..... 428/336
4,929,322 5/1990 Sue et al. ..... 204/192.38
5,051,140 9/1991 Mushiaku et al. ..... 148/203
5,066,513 11/1991 Zurecki et al. ..... 427/37
5,175,020 12/1992 Doellein et al. ..... 427/569

*Primary Examiner*—A. Michael Chambers
*Attorney, Agent, or Firm*—Albert E. Chrow

[57] ABSTRACT

A method is provided that in one embodiment is operative to form a wear resistant coating of titanium nitride on the outer surface of a metal valve such as an internal combustion engine poppet valve (100). In another embodiment, the method is operative to provide a valve made from titanium with an in situ zone of titanium nitride extending inwardly from the valve's outer surface. In yet another embodiment, the method is operative to provide a valve made from titanium with both a coating of titanium on the valve's outer surface and an in situ zone of titanium nitride extending inwardly from the valve's outer surface.

5 Claims, 2 Drawing Sheets

TITANIUM NITRIDE COATED VALVE AND METHOD FOR MAKING

INTRODUCTION

This invention relates generally to a titanium nitride coated valve and more particularly to a method for coating a metal valve with titanium nitride and even more particularly to a method for providing a titanium nitride zone in situ extending inwardly from the outer surface of a titanium valve that is substantially uniform in thickness and strongly adhered to the titanium substrate therebeneath.

BACKGROUND OF THE INVENTION

There is a present trend to operate internal combustion engines at higher temperatures and engine speeds to provide improved fuel efficiency and increased power output. The trend to such higher temperatures and speeds places severe demands and increases wear on the engine's reciprocating components such as valve components and poppet valves in particular.

As the mass of the reciprocating components becomes a hinderance to higher speed operations, there is a growing interest to minimize the weights of the reciprocating components.

Titanium has been found to possess lighter weight and high temperature resistance characteristics attractively advantageous for making engine poppet valves operating at such higher temperature and speeds.

It has been found however, that the wear resistance and, in some instances, the strength and ductility of titanium requires improvement to insure long term engine operation at such higher temperatures and speeds as, for example, where it has been the practice to cap or otherwise provide a wear resistant material at the tip of the valve stem which is a region that has been found to be particularly subject to wear.

A variety of approaches have been taken in the past to improve either or both the strength and wear resistance of titanium valves for use under such higher engine operating temperature and speeds.

One approach to increasing the strength of a titanium valve stem is disclosed in U.S. Pat. No. 4,852,531, the disclosure of which is incorporated herein by reference, where particles of compounds selected from the group consisting of titanium carbide, titanium boride, and titanium diboride are mixed in prescribed amounts with powdered titanium in the making of the valve stem.

Another approach to improving the wear resistance of titanium is disclosed in U.S. Pat. No. 5,051,140, the disclosure of which is incorporated herein by reference. Here, the surface of the titanium article is cleaned with an acid and heated in an oxidative atmosphere to provide a composite layering thereupon of oxide and oxygen-enriched layers.

Another method for improving the performance of titanium engine valves at higher operating temperatures and speeds is disclosed in U.S. Pat. No. 4,675,964, the disclosure of which is incorporated herein by referenced. Here, the valve head is heated and worked to provide a colony type microstructure highly resistant to heat to provide a mixture of five equiaxed alpha and transformed beta crystalline grains exhibiting high resistance to tensile shock and fatigue.

The application of titanium nitride coatings by a reactive arc vapor deposition process for improving erosion resistance of titanium alloy turbine blades is known and described for example in U.S. Pat. No. 4,904,528, the disclosure of which is incorporated herein by reference. This patent as well as U.S. Pat. Nos. 4,929,322 and 5,066,515, the disclosures of which are incorporated herein by reference, describe what is essentially a plasma arc method of applying a suitable coating on a substrate that requires the creation of a vacuum which is not the case for the process of the present invention which involves an electro deposition process utilizing pressurized nitrogen.

The present invention is directed to the discovery of a method for forming a titanium nitride coating on the surface of metal valves in one embodiment and the formation of a zone of titanium nitride in situ extending inwardly from the outer surface of a titanium valve in another embodiment and to a combination of the two in a third embodiment to enhance abrasion resistance at the higher engine temperature and speeds. All three embodiments involve alteration of the metal metallurgical microstructure and exposure to ionized nitrogen at nitriding temperatures while an electrical potential is imposed between the valve and a cathode to provide the coating and/or in situ zone of titanium nitride that is substantially uniform in thickness and strongly adhered to the metal substrate therebeneath.

SUMMARY OF THE INVENTION

Accordingly, it is an object of this invention to provide a method of forming a coating of titanium nitride on the outer surface or an in situ zone of titanium nitride extending inwardly from the outer surface of a valve.

It is another object of this invention to provide a method for creating an in situ zone of titanium nitride extending inwardly from the outer surface of a titanium valve.

It is another object of this invention to provide a titanium nitride coating on the outer surface of a metal valve and/or a zone of titanium nitride in situ extending inwardly from the outer surface of a titanium valve that is substantially uniform in thickness and strongly adhered to the metal substrate therebeneath.

It is still another object of this invention to provide a valve having a titanium nitride coating on the outer surface and/or an in situ zone of titanium nitride extending inwardly from the outer surface to enhance wear resistance of the valve.

DESCRIPTION OF SOME PREFERRED EMBODIMENTS

Figure 1:
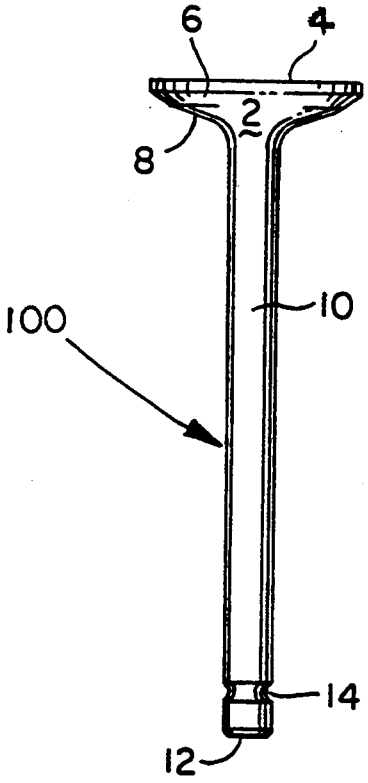
FIG. 1 is a side elevation view of an engine poppet valve 100 having a coating or in situ zone of titanium thereupon in accordance with the invention.

Valve 100 of FIGURE I is an internal combustion engine poppet valve that is required to operate at high engine speeds characteristically of about 7000 RPM and at engine combustion chamber temperatures as high as about 900° C. whereas the operating speed and temperature for lower speed engines is commonly about 700° C. and about 2500 RPM respectively.

Valve 100 has a generally circular enlarged head 2 having a combustion face 4 that faces into the combustion chamber of an internal combustion engine (not shown) in which it is installed and is accordingly exposed to the high heat of combustion that, as earlier described, can be as high as about 900° C. as hereinafter described in more detail with respect to FIG. 2.

A generally cylindrical elongate stem 10 extends from an opposite side of head 2 from combustion face 4. Stem 10 is oriented substantially transverse to combustion face 4 and is reinforced relative its joinder with head 2 by means of fillet 8. Stem 10 ends in a tip 12 adjacent to which is an annular keeper groove 14 into which a snap-ring or the like is used to contain a resilient member such as a coiled spring (not shown) that is disposed coaxially about stem 10 in a manner effective to move valve 100 downwardly to the rest position shown in FIG. 2 during combustion of the fuel after having been moved upwardly by means of a cam or the like that engages tip 12.

Figure 2:
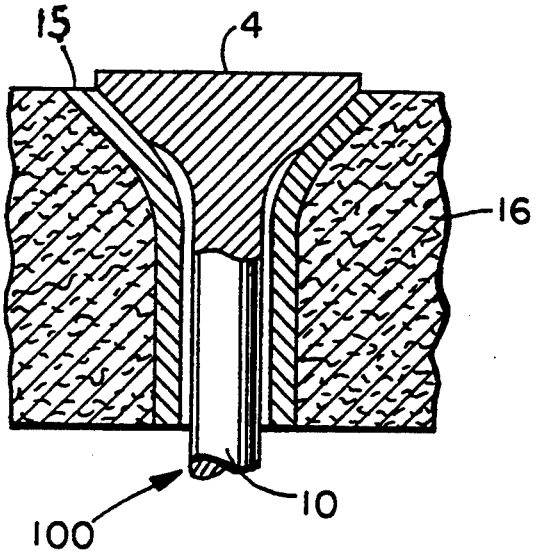
FIG. 2 is a partial central cross-sectional side view through valve 100 of FIG. 1 positioned in an engine block insert.

Head 2 has an annular seat face 6 extending about its periphery that engages a mating surface in valve insert 14 shown in FIG. 2 during its downward stroke to the closed position shown in FIG. 2 just prior to combustion of the fuel that entered into the combustion chamber.

As shown in FIG. 2, annular seat face 6 surrounding the head of valve 100 engages guide insert 15 which is secured to an opening through engine block 16 so that combustion face 4 can face into the engine's combustion chamber. Stem 10 extends from the head of valve 100 through an opening 11 through insert 15 and therebeyond 8 where it ends in tip 12 (not shown in FIG. 2).

Although insert 15 is commonly made from materials having low friction factors, high speed reciprocating action of stem 10 within opening 11 at high temperatures will likely still lead to scuffing and wear. As such, the method of the invention is operative to provide a coating and/or an in situ zone of titanium nitride adjacent the entire valve outer surface and which can selectively omit the combustion face of the valve if desired.

Valve 100 can be made from for example a suitable metal such as a suitable steel alloy containing by weight from about 0.01% to about 2% carbon and from about 0.05% to about 1.0% silicon to lessen weight as previously described. The difference in the metal substrate from which the valve is made determines whether titanium nitride is applied as a coating or is created in situ as a zone extending inwardly from the outer surface of the valve or is a combination of both as hereinafter more fully described with respect to FIG. 3.

Figure 3:
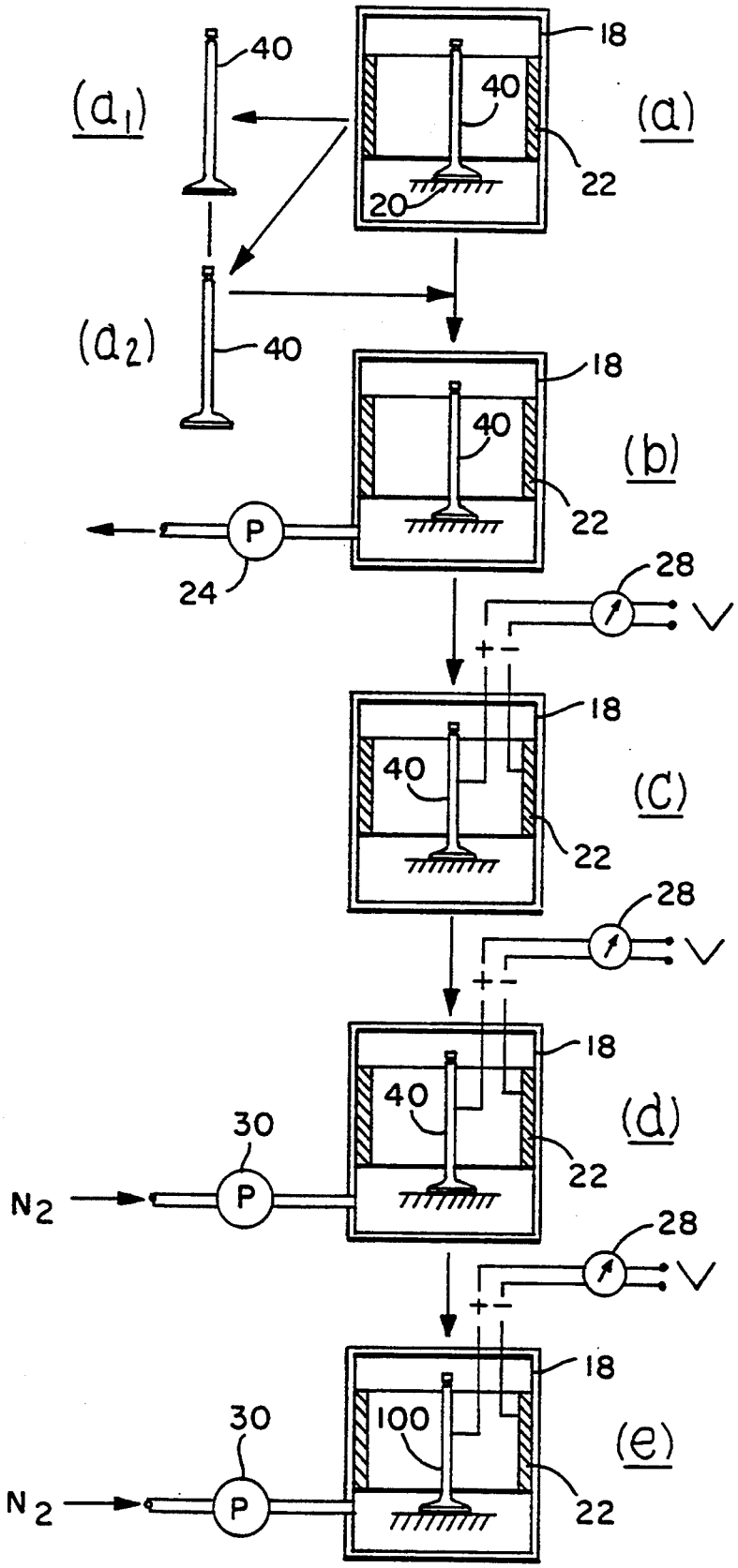
FIG. 3 is a block diagram of a preferred method by which valve 100 of FIGS. 1 and 2 is provided with a coating and/or an in situ zone of titanium nitride.

In FIG. 3, the method begins in step (a) by cyclicly annealing a metal valve 40 in a furnace 18. Since the same furnace 18 may be used throughout the entire process, it is referenced by numeral 18 in all of steps (a) through (e) herein described. A plurality of valves 40 may be suspended in furnace 18 so that their combustion faces are exposed or they may stand on end with their respective combustion faces resting on a platform in furnace 18 referenced by numeral 20 in which case their respective combustion faces will not be exposed to titanium nitride within furnace 18.

When valve 40 is made from a suitable metal other than titanium, it is cyclicly annealed at predetermined temperatures below and above a predetermined metallurgical transition temperature for a period of time at each temperature and for a number of cycles operative to provide the particular metallurgical microstructure desired. For example, the transition temperature for an austenizible steel alloy by weight from about 0.25% to about 0.45% carbon; about 0.01% to about 2.5% magnesium; about 21% to about 30% chromium; about 2% to about 10% nickle; about 0.35% to about 0.55% nitrogen; about 2% maximum silicon; trace amount of phosphorus and sulfur and the remainder substantially iron is 1500° C. In such case, the temperature below the transition temperature is preferably about 1400° C. and the temperature above the transition temperature is preferably about 1600° C. and the time at each temperature is preferably about one hour and the number of cycles is preferably about 2–4.

In the case where valve 40 is made from titanium, the transition temperature is called the transus temperature and more particularly the beta transus temperature which is the temperature at which a titanium alpha ($\alpha$) microstructure transforms to a beta ($\beta$) microstructure which is known to be more heat resistant. In the case of a titanium valve, it has been found that a substantially uniform alpha/beta microstructure is provided when the valve is cyclicly annealed at a temperature below the transus temperature of about 730° C. for about one hour and at a temperature above the transus temperature of about 930° C. for about one hour preferably for at least two cycles.

For purposes of the present invention, the term "titanium", as used herein, includes titanium itself and also titanium alloys in which titanium constitutes at least 50% or more by weight or volume.

Also shown in step (a) of FIG. 3, is an electrical cathode 22 that, like furnace 18, may be included in all of steps (a)–(e) if desired or may be associated with a separate furnace that is utilized beginning with step (c).

After cyclicly annealing valve 40 in step (a), the stem of valve 40 may require straightening which as referenced by numeral ($a_1$) in FIG. 3. Valve 40 is finish machined in step ($a_2$) either after step ($a_1$) or directly after step (a) as shown by the arrows in cases where straightening of the stem is not required. If straightening of the stem is required, it has been found that for a titanium valve such can be advantageously accomplished by mechanically straightening the stem while it is heated to a temperature of from about 200° C. to about 700° C. after which it is stress relieved at a temperature of about 815° C. for a time period of about 10 to about 100 minutes.

In step (b), valve 40 is heated to a nitriding temperature of about 700° C. to about 880° C. in furnace 18 while the furnace is evacuated such as by a vacuum pump referenced by numeral 24 that evacuates the chamber within furnace 18 in which the valves are located to a vacuum level of preferably about 50 microns to about 5 torr.

In step (c), an electrical potential derived from a 9 to about 800 D.C. voltage source (referenced by the letter "V") is imposed between valve 40 and cathode 22 with valve 40 acting as the anode. Although cathode 22 may be positioned at a particular location within furnace 18 in spaced apart relationship to valve 40, it preferably encircles valve 40 to enhance uniformity of the titanium nitriding process.

When valve 40 is made from metal other than titanium, cathode 22 is made from titanium to provide a source of titanium for reacting with ionized nitrogen.

In cases where valve 40 is made from titanium, cathode 22 is not required to be made from titanium and may be the wall of furnace 18 (presuming the wall is made from an electrically conductive material) in cases where both valve 40 and cathode 22 are made from titanium, the method of the invention is operative to provide a combination of a coating of titanium nitride over the valve outer surface and an in situ zone of titanium nitride extending inwardly from the valve outer surface.

In step (d), valve 40 is exposed to pressurized nitrogen and in step (e) at least one of the electrical potential and nitrogen pressure is adjusted to produce ionized nitrogen within furnace 18 that, when valve 40 is made from titanium, defuses into valve 40 for a defined zone thickness beneath the surface and reacts with the titanium substrate to provide the in situ zone of titanium nitride extending inwardly from the outer surface of valve 40. A preferred nitrogen pressure and voltage for step (e) are about 1600 torr and about 600 volts D.C. respectively where one torr is equal to 1 millimeter of mercury.

In cases where the cathode is made from titanium, titanium ions are driven by the electrical potential gradient from the cathode toward valve 40 during the course of which they react with the ionized nitrogen to provide titanium nitride that impinges upon and forms a coating of titanium nitride over the outer surface of valve 40 that is substantially uniform in thickness and strongly adhered to to the substrate to provide the valve with an outer surface resistant to wear at high temperatures.

The method of the invention is in effect a plasma coating process that combines an electrical potential with heated pressurized nitrogen in a manner that produces ionized nitrogen that can advantageously react with the titanium substrate of a titanium valve and with titanium ions that are omitted from a titanium cathode within a furnace in which the valve is exposed to ionized nitrogen. Likewise, when both the valve and the cathode are made from titanium, a combination of both an in situ zone of titanium nitride extending inwardly from the outer surface and a coating of titanium nitride over the outer surface is provided as previously described.

Although steps (e) and (d) show nitrogen being pumped into furnace 18 by a pump 30, such is for illustrative purposes only for the nitrogen sources may be one or more tanks or bottles of pressurized nitrogen that can be released into furnace 18 under controlled pressure conditions.

It has been found that for a titanium valve a uniform in situ zone of titanium nitride is provided in step (e) when the electrical potential is about 600 V and the nitriding temperature is about 700°–800° C. and the valve is exposed to the ionized nitrogen for a time period of about 4 hours to about 15 hours.

Additionally, the valves may be cleaned when required such as by sputter cleaning as they are heated up to the nitriding temperature in step (b) in the presence of a low pressure gas such as argon or nitrogen.

Although the steps of the invention have been described herein as a particular order, the order of steps (b) through (d) may be altered provided the overall result is the formation of ionized nitrogen in step (e)and step (e) may merge with step (f) when the nitrogen pressure and electrical potential are known and are effective without adjustment.

What is claimed:

1. A titanium valve having an in situ zone of titanium nitride extending inwardly from the outer surface thereof made by a method including the steps of:

(a) cyclicly annealing the valve at predetermined temperatures below and above a pre-established metallurgical microstructure transition temperature for the titanium for a number of cycles and for a period of time at each temperature sufficient to establish the metallurgical microstructure characteristics desired, (b) heating the valve of step (a) up to a predetermined nitriding temperature while under controlled vacuum in a furnace, (c) applying an electrical potential between a cathode and the valve of step (b) while heating the valve in the furnace, (d) exposing the valve of step (c) to pressurized nitrogen in a halogen-free atmosphere, (e) adjusting at least one of the nitrogen pressure or the electrical potential between the valve and the cathode of step (d) so as to ionize the nitrogen and initiate titanium ion migration from the cathode toward the valve, and (f) holding the valve of step (e) at the predetermined nitriding temperature for a period of time sufficient to enable the migrating titanium as to react with the ionized nitrogen and form the titanium coating on the valve.

2. A titanium valve having a combination of a titanium nitride coating on the outer surface thereof and an in situ zone of titanium nitride extending inwardly from the valve's outer surface made by a method including the steps of:

(a) cyclicly annealing the valve at predetermined temperatures below and above a pre-established metallurgical microstructure transition temperature for the titanium for a number of cycles and for a period of time at each temperature sufficient to establish the metallurgical microstructure characteristics desired, (b) heating the valve of step (a) up to a predetermined nitriding temperature while under controlled vacuum in a furnace, (c) applying an electrical potential between a titanium cathode and the valve of step (b) while heating the valve in the furnace, (d) exposing the valve of step (c) to pressurized nitrogen in a halogen-free atmosphere, (e) adjusting at least one of the nitrogen pressure or the electrical potential between the valve and the cathode of step (d) so as to ionize the nitrogen and initiate titanium ion migration from the cathode toward the valve.

(f) holding the valve of step (e) at the predetermined nitriding temperature for a period of time sufficient to enable the migrating titanium as to react with the ionized nitrogen and form the titanium nitride coating on the valve.

3. The valve of claim 1 or 2 wherein the temperature below the beta transus temperature is about 730° C. and the temperature above the beta transus temperature is about 930° C.

4. The valve of claim 1 or 2 wherein the time at the respective temperature above and below the beta transus temperature is about one hour.

5. The valve of claim 1 or 2 wherein the nitrogen pressure and the electrical potential of step (e) are about 1600 torr and about 600 volts D.C. respectively.

* * * * *